US008591257B2

(12) United States Patent
Girard et al.

(10) Patent No.: US 8,591,257 B2
(45) Date of Patent: Nov. 26, 2013

(54) ELECTRICAL CONNECTOR HAVING IMPEDANCE MATCHED INTERMEDIATE CONNECTION POINTS

(75) Inventors: Donald A. Girard, Bedford, NH (US); Mark W. Gailus, Concord, MA (US); Jerry Proulx, Londonderry, NH (US); Edward Gerald Marvin, New Castle, NH (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/298,869

(22) Filed: Nov. 17, 2011

(65) Prior Publication Data

US 2013/0130554 A1 May 23, 2013

(51) Int. Cl.
*H01R 13/66* (2006.01)

(52) U.S. Cl.
USPC ..... 439/607.07

(58) Field of Classification Search
USPC ..... 439/607.06, 607.07, 620.09, 620.13, 439/607.09, 607.13
See application file for complete search history.

(56) References Cited

U.S. PATENT DOCUMENTS

| | | | |
|---|---|---|---|
| 1,779,472 | A | 10/1930 | Imingen |
| 3,115,379 | A | 12/1963 | McKee |
| 3,825,994 | A | 7/1974 | Coleman |
| 3,978,375 | A | 8/1976 | Fukui et al. |
| 4,464,003 | A | 8/1984 | Goodman et al. |
| 4,596,428 | A | 6/1986 | Tengler |
| 4,655,515 | A | 4/1987 | Hamsher, Jr. et al. |
| 4,675,989 | A | 6/1987 | Galloway et al. |
| 4,705,332 | A | 11/1987 | Sadigh-Behzadi |
| 4,820,169 | A | 4/1989 | Weber et al. |
| 4,824,383 | A | 4/1989 | Lemke |
| 4,846,727 | A | 7/1989 | Glover et al. |
| 4,878,155 | A | 10/1989 | Conley |
| 4,882,554 | A | 11/1989 | Akaba et al. |
| 4,952,172 | A | 8/1990 | Barkus et al. |

(Continued)

FOREIGN PATENT DOCUMENTS

| | | |
|---|---|---|
| EP | 0212764 A2 | 3/1987 |
| EP | 0422785 A2 | 4/1991 |

(Continued)

OTHER PUBLICATIONS

Author Unknown, KEMET Electronics, Ceramic Capacitors, 2003, 1 p., Kemet Electronics Corporation, http://www.kemet.com/kemet/web/homepage/kechome.nsf/vaprintpages/ceramic.

(Continued)

*Primary Examiner* — Gary F. Paumen
(74) *Attorney, Agent, or Firm* — Blank Rome LLP

(57) ABSTRACT

An electrical wafer for electrically connecting to a printed circuit board. The electrical wafer includes an insulative housing and at least one signal conductor disposed in the insulative housing. The at least one signal conductor includes an intermediate portion having a connection point. The connection point includes first and second ends, at least one of which has a width greater than a portion of the at least one signal conductor outside the connection point. The insulative housing has at least one aperture exposing at least a portion of the connection point. A portion of the connection point may be punched out, and a passive circuit element may be placed within the at least one aperture and mounted to the connection point. Multiple electrical wafers may be coupled together by a stiffener and connected to a backplane connector.

20 Claims, 16 Drawing Sheets

(56) References Cited

U.S. PATENT DOCUMENTS

| | | | | |
|---|---|---|---|---|
| 4,965,933 | A | 10/1990 | Mraz et al. | |
| 4,975,069 | A | 12/1990 | Fedder et al. | |
| 4,975,084 | A | 12/1990 | Fedder et al. | |
| 5,046,960 | A | 9/1991 | Fedder | |
| 5,066,236 | A | 11/1991 | Broeksteeg | |
| 5,104,341 | A | 4/1992 | Gilissen et al. | |
| 5,117,331 | A | 5/1992 | Gebara | |
| 5,153,540 | A | 10/1992 | Gliha, Jr. | |
| 5,163,540 | A | 11/1992 | Mainquist et al. | |
| 5,224,867 | A | 7/1993 | Ohtsuki et al. | |
| 5,228,824 | A | 7/1993 | Satoyoshi | |
| 5,228,864 | A | 7/1993 | Fusselman et al. | |
| 5,249,098 | A | 9/1993 | Rostoker et al. | |
| 5,286,212 | A | 2/1994 | Broeksteeg | |
| 5,287,076 | A | 2/1994 | Johnescu et al. | |
| 5,340,334 | A | 8/1994 | Nguyen | |
| 5,342,211 | A | 8/1994 | Broeksteeg | |
| 5,403,206 | A | 4/1995 | McNamara et al. | |
| 5,496,183 | A | 3/1996 | Soes et al. | |
| 5,525,066 | A | 6/1996 | Morlion et al. | |
| 5,580,283 | A | 12/1996 | O'Sullivan et al. | |
| 5,702,258 | A | 12/1997 | Provencher et al. | |
| 5,795,191 | A | 8/1998 | Preputnick et al. | |
| 5,860,816 | A | 1/1999 | Provencher et al. | |
| 5,924,899 | A | 7/1999 | Paagman | |
| 5,941,447 | A | 8/1999 | Chu et al. | |
| 5,980,321 | A | 11/1999 | Cohen et al. | |
| 6,019,616 | A | 2/2000 | Yagi et al. | |
| 6,083,047 | A | 7/2000 | Paagman | |
| 6,152,742 | A | 11/2000 | Cohen et al. | |
| 6,168,469 | B1 | 1/2001 | Lu | |
| 6,183,301 | B1 | 2/2001 | Paagman | |
| 6,325,644 | B1 | 12/2001 | Lemke et al. | |
| 6,375,510 | B2 | 4/2002 | Asao | |
| 6,379,188 | B1 | 4/2002 | Cohen et al. | |
| 6,409,543 | B1 * | 6/2002 | Astbury et al. | 439/607.07 |
| 6,530,790 | B1 | 3/2003 | McNamara et al. | |
| 6,537,087 | B2 | 3/2003 | McNamara et al. | |
| 6,592,382 | B2 | 7/2003 | Wurster | |
| 6,623,280 | B2 | 9/2003 | Oldenburg et al. | |
| 6,652,318 | B1 | 11/2003 | Winings et al. | |
| 6,786,771 | B2 | 9/2004 | Gailus | |
| 6,932,649 | B1 | 8/2005 | Rothermel et al. | |
| 7,285,018 | B2 * | 10/2007 | Kenny et al. | 439/620.01 |
| 7,540,781 | B2 * | 6/2009 | Kenny et al. | 439/620.16 |
| 7,794,240 | B2 | 9/2010 | Cohen et al. | |
| 7,887,371 | B2 * | 2/2011 | Kenny et al. | 439/620.22 |
| 8,123,563 | B2 * | 2/2012 | Kenny et al. | 439/620.22 |
| 2002/0098738 | A1 | 7/2002 | Astbury et al. | |
| 2003/0203683 | A1 | 10/2003 | Iwasaki | |
| 2004/0110421 | A1 | 6/2004 | Broman et al. | |
| 2004/0171305 | A1 * | 9/2004 | McGowan et al. | 439/608 |
| 2005/0032430 | A1 | 2/2005 | Otsu et al. | |
| 2005/0121224 | A1 | 6/2005 | Lien | |
| 2009/0298308 | A1 | 12/2009 | Kenny et al. | |

FOREIGN PATENT DOCUMENTS

| | | | |
|---|---|---|---|
| EP | 0486298 | A1 | 5/1992 |
| EP | 0560550 | | 9/1993 |
| EP | 0560551 | A1 | 9/1993 |
| EP | 0560553 | A1 | 9/1993 |
| EP | 1779472 | A1 | 5/2007 |
| GB | 2325354 | A | 11/1998 |
| JP | 5069890 | A | 3/1993 |
| JP | 6013133 | A | 1/1994 |
| JP | 6029060 | A | 2/1994 |
| JP | 6054257 | A | 2/1994 |
| JP | 6054259 | A | 2/1994 |
| JP | 08054274 | A | 2/1994 |
| JP | 06084557 | A | 3/1994 |
| JP | 06325829 | A | 11/1994 |
| JP | 07006023 | A | 1/1995 |
| JP | 07006823 | A1 | 1/1995 |
| JP | 07027059 | A | 1/1995 |
| JP | 07302649 | A | 11/1995 |
| JP | 9237656 | A | 9/1997 |
| JP | 10162909 | A | 6/1998 |
| JP | 10270124 | A | 10/1998 |
| JP | 10270133 | A | 10/1998 |
| JP | 10275662 | A | 10/1998 |
| JP | 10284194 | A | 10/1998 |
| JP | 10302895 | A | 11/1998 |
| WO | 8805218 | A1 | 7/1988 |
| WO | 9638889 | A1 | 12/1990 |
| WO | 0031832 | A1 | 6/2000 |

OTHER PUBLICATIONS

Author Unknown, KEMET Electronics—Tantalum Capacitators, KEMET Electronics Corporation, 2003, 1 p.

* cited by examiner

ELECTRICAL CONNECTOR HAVING IMPEDANCE MATCHED INTERMEDIATE CONNECTION POINTS

FIELD OF THE INVENTION

This invention relates generally to an electrical connector for connecting printed circuit boards and methods of manufacturing such an electrical connector and, more specifically, to an electrical connector comprising one or more wafers having impedance matched connection points for passive circuit elements.

BACKGROUND OF THE INVENTION

Modern electronic circuitry is often built on printed circuit boards. The printed circuit boards are then interconnected to create an electronic system, such as a server or a router for a communications network. Electrical connectors are generally used to make these interconnections between the printed circuit boards. Typically, connectors are made of two pieces, with one piece on one printed circuit board and the other piece on another printed circuit board. The two pieces of the connector assembly mate to provide signal paths between the printed circuit boards.

An electrical connector should generally have a combination of several properties. For example, it should provide signal paths with appropriate electrical properties such that the signals are not unduly distorted as they move between the printed circuit boards. In addition, the connector should ensure that the two pieces mate easily and reliably. Furthermore, the connector should be rugged so that it is not easily damaged by handling of the printed circuit boards. For many applications, it is also important that the connector have high density, meaning that the connector can carry a large number of electrical signals per unit length.

Examples of electrical connectors possessing these desirable properties include VHDM®, VHDM®-HSD, and GbX® connectors manufactured and sold by the assignee of the present invention, Teradyne, Inc.

One of the disadvantages of conventional electronic systems is the need, oftentimes, to populate the surfaces of the interconnected printed circuit boards with passive circuit elements. These passive circuit elements, such as capacitors, inductors and resistors, may be needed, for example: (i) to block or at least reduce the flow of direct current ("DC") caused by potential differences between various electronic components on the interconnected printed circuit boards; (ii) to provide desired filtering characteristics; and/or (iii) to reduce data transmission losses. However, these passive circuit elements take up precious space on the board surface (thus reducing the space available for signal paths). In addition, where these passive circuit elements on the board surface are connected to conductive vias, there could be undesirable signal reflections at certain frequencies due to impedance discontinuity and resonant stub effects.

What is desired, therefore, is an electrical connector and methods of manufacturing such an electrical connector that generally possesses the desirable properties of the existing connectors described above, but also provides passive circuit elements in the connector to deliver the desired qualities provided by the passive circuit elements described above. And it is further desired that such an electrical connector provide the passive circuit elements cost effectively.

SUMMARY OF THE INVENTION

In accordance with an aspect of the present invention, there is provided an electrical wafer for connecting to a printed circuit board. The electrical wafer includes an insulative housing and at least one signal conductor including an intermediate portion having a connection point. The connection point includes first and second ends. At least one of the first and second ends has a width greater than a portion of the at least one signal conductor outside the connection point. The insulative housing includes at least one aperture exposing at least a portion of the connection point.

In accordance with another aspect of the present invention, there is provided an electrical connector including a plurality of wafers and a stiffener configured to hold the plurality of wafers in parallel to one another. Each wafer includes an insulative housing and at least one signal conductor including an intermediate portion having a connection point. The connection point includes first and second ends. At least one of the first and second ends has a width greater than a portion of the at least one signal conductor outside the connection point. The insulative housing of each wafer includes at least one aperture exposing at least a portion of the connection point of the at least one signal conductor of each wafer.

In accordance with yet another aspect of the present invention, there is provided an electrical connector assembly including a plurality of wafers, a stiffener configured to hold the plurality of wafers in parallel to one another, and a back plane connector configured to connect to a first end of each wafer. Each wafer includes an insulative housing and at least one signal conductor including an intermediate portion having a connection point. The connection point includes first and second ends. At least one of the first and second ends has a width greater than a portion of the at least one signal conductor outside the connection point. The insulative housing of each wafer includes at least one aperture exposing at least a portion of the connection point of the at least one signal conductor of each wafer.

BRIEF DESCRIPTION OF THE DRAWINGS

For the purpose of illustration, there are shown in the drawings certain embodiments of the present invention. In the drawings, like numerals indicate like elements throughout. It should be understood, however, that the invention is not limited to the precise arrangements, dimensions, and instruments shown. In the drawings.

DETAILED DESCRIPTION OF THE INVENTION

Figure 1:
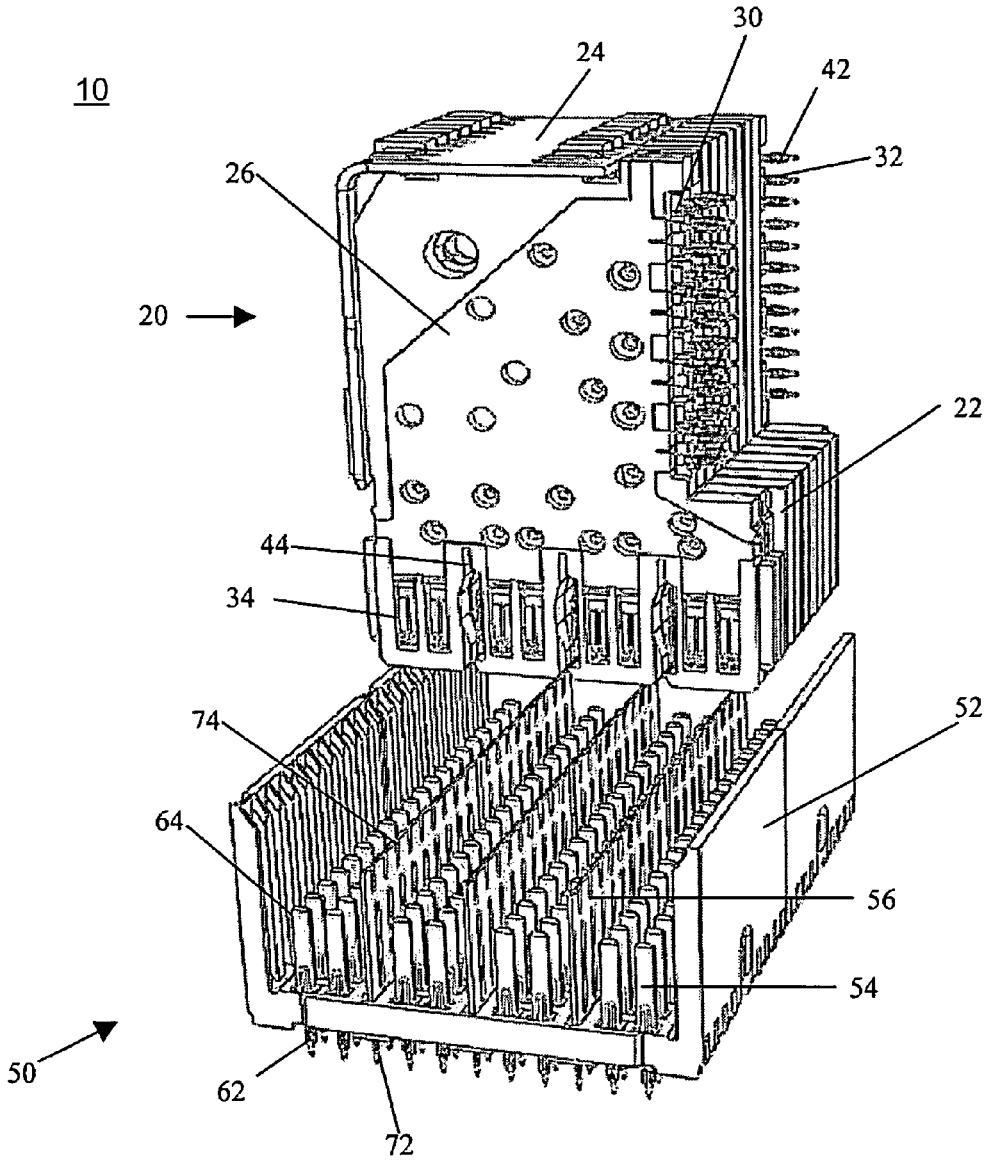
FIG. 1 (Prior Art)
FIG. 1 shows a perspective view of a prior art electrical connector assembly comprising an electrical connector and a backplane connector, the electrical connector comprising a plurality of prior-art wafers.

FIG. 1 shows a perspective view of a prior art electrical connector assembly 10 illustrated as FIG. 1 in U.S. Pat. No. 6,409,543. The '543 patent, which is directed to the GbX® connector, is assigned to the assignee of the present invention and is incorporated by reference herein. The electrical connector assembly 10 includes a daughtercard connector 20 that is connectable to a first printed circuit board (not shown) and a backplane connector 50 that is connectable to a second printed circuit board (not shown). The daughtercard connector 20 has a plurality of modules or wafers 22 which are preferably held together by a stiffener 24.

Each wafer 22 includes a plurality of signal conductors (not shown), a shield plate (not shown), and a dielectric housing 26 that is formed around at least a portion of each of the plurality of signal conductors and the shield plate. Each of the signal conductors has a first contact end 32 connectable to the first printed circuit board and a second contact end 34 mateable to the backplane connector 50. Each shield plate has a first contact end 42 connectable to the first printed circuit board and a second contact end 44 mateable to the backplane connector 50.

The backplane connector 50 includes an insulative housing 52 and a plurality of signal conductors 54 held by the insulative housing 52. The plurality of signal conductors of the wafer 22 and the backplane connector 50 is arranged in an array of differential signal pairs. The backplane connector 50 also includes a plurality of shield plates 56 that are located between rows of differential signal pairs. Each of the signal conductors 54 has a first contact end 62 connectable to the second printed circuit board and a second contact end 64 mateable to the second contact end 34 of the corresponding signal conductor 30 of the daughtercard connector 20. Each shield plate 56 has a first contact end 72 connectable to the second printed circuit board and a second contact end 74 mateable to the second contact end 44 of the corresponding shield plate of the daughtercard connector 20.

The wafers 22 do not have passive circuit elements that would provide desirable characteristics, such as DC flow minimization, desired filtering characteristics, or data transmission loss reduction.

Figure 2:
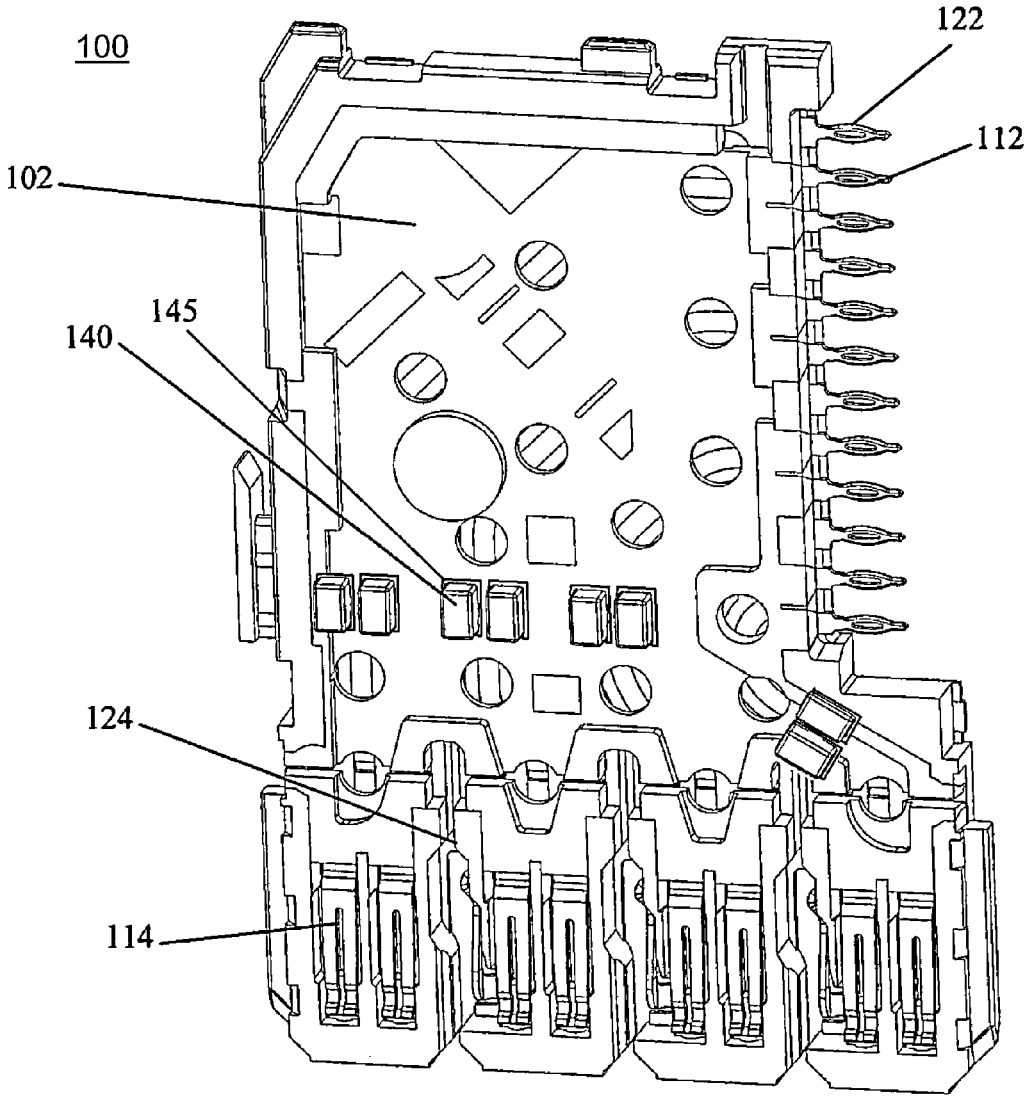
FIG. 2 (Prior Art)
FIG. 2 shows a perspective view of one of the prior-art wafers of FIG. 1.

FIG. 2 shows a perspective view of another prior art wafer, generally designated as 100 in FIG. 1 and illustrated in FIG. 2 of U.S. Pat. No. 7,285,018. The '018 patent is assigned to the assignee of the present invention and is incorporated by reference herein. The '018 patent describes the wafer 100 as addressing some of the desires noted in the Background of the Invention section of the '018 patent, which desires are repeated herein in the Background of the Invention section.

With reference to FIG. 2 herein, the wafer 100 includes a plurality of signal conductors 110 and an insulative housing 102. The signal conductors 110 are more clearly shown in FIG. 3, which illustrates the wafer 100 of FIG. 2 with a portion of the insulative housing 102 removed from the drawing to reveal the signal conductors 110.

Figure 3:
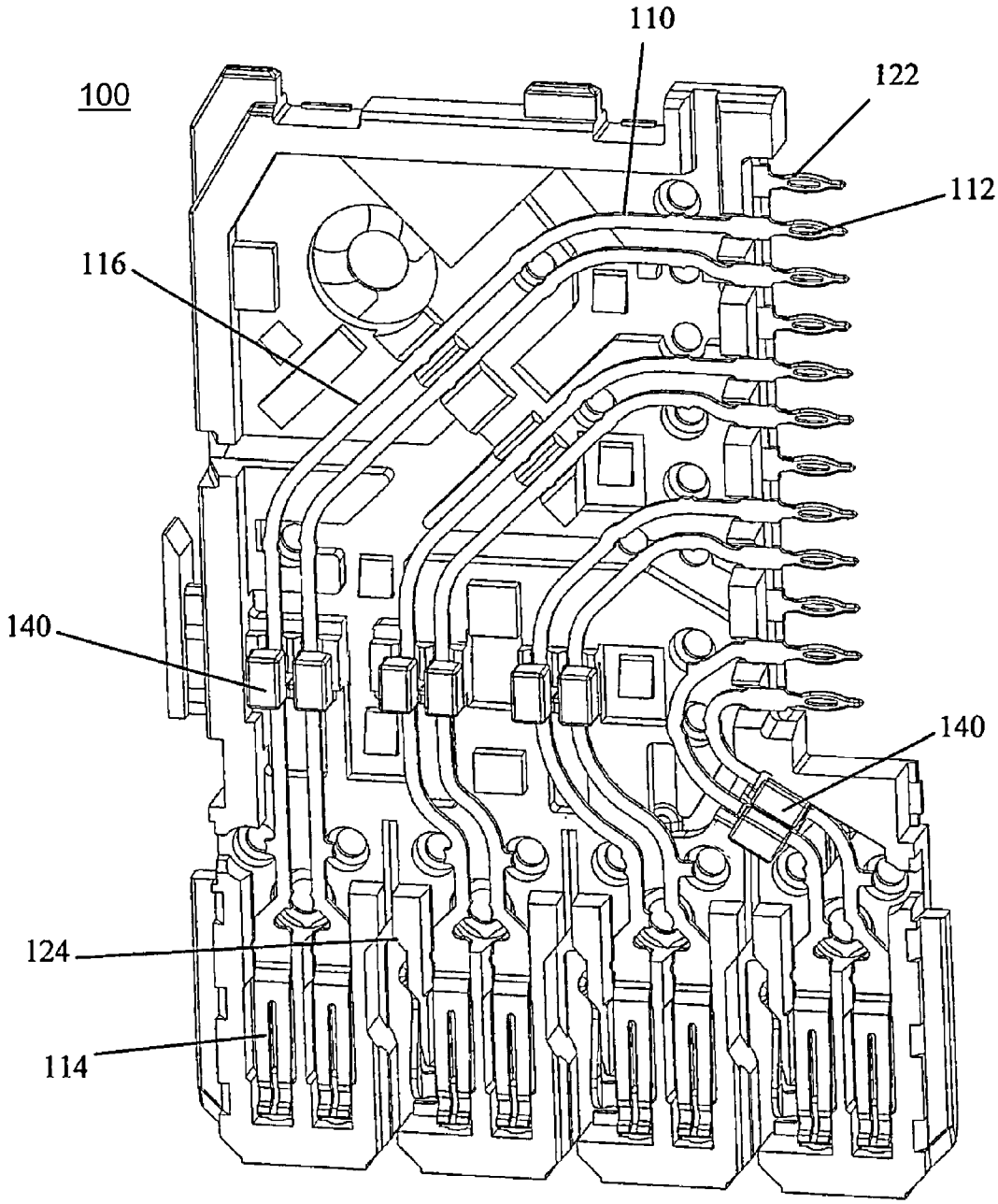
FIG. 3 (Prior Art)
FIG. 3 shows a perspective internal view of the prior-art wafer of FIG. 2.

Referring to FIGS. 2 and 3, the signal conductors 110 are arranged as differential signal pairs. Each signal conductor 110 has a first contact end 112, a second contact end 114, and an intermediate portion 116 therebetween. The intermediate portion 116 of the signal conductor 110 is disposed within the insulative housing 102. The wafer 100 also includes a ground conductor member or a shield plate having a first contact end 122 and a second contact end 124. The first contact ends 112, 122, which are illustrated as press-fit "eye of the needle" contact ends, are connectable to a first printed circuit board (not shown). The second contact ends 114, 124 are connectable to the backplane connector 50 of FIG. 1.

Attached to the intermediate portion 116 of each signal conductor 110 is a passive circuit element 140. Each passive circuit element 140 is disposed in an aperture 145 in the insulative housing 102 and extends entirely through the insulative housing 102 and beyond the outer surface of the insulative housing 102. The passive circuit element 140 includes at least a capacitor or an inductor housed in an insulative package and is a commercially available off-the-shelf component. For example, if the passive circuit element 140 is desired to function as a direct current blocking circuit, then one of the ceramic or tantalum chip capacitors that are sold by KEMET Electronics Corporation of Greenville, S.C. can be utilized. If the passive circuit element 140 is desired to function as a high frequency passive equalization circuit, then one of the resistor/inductor/capacitor packages that are sold by Maxim Integrated Products, Inc. of Sunnyvale, Calif. can be utilized.

As illustrated in FIG. 2, the passive circuit elements 140 are disposed within the apertures 145. The apertures 145 are voids in the insulative housing 102 providing access to the interior of insulative housing 102 and the conductors 110 so that the passive circuit elements 140 may be connected to the conductors 110, as needed. Because the insulative housing 102 is formed from a dielectric, the apertures 145, while desirable for installing the passive circuit elements 140, change the impedance in the conductors 110 in the apertures 145 compared to the portions of the conductors 110 not in the apertures. If signals in the 5-25 GHz range are applied to the conductors 110, the impedance mismatch in the conductors 110 (with or without the passive circuit elements 140) may increase transmission loses, e.g., by introducing undesirable signal reflections. Accordingly, a wafer with matched impedance connection points for passive circuit elements is desirable.

Figure 4:
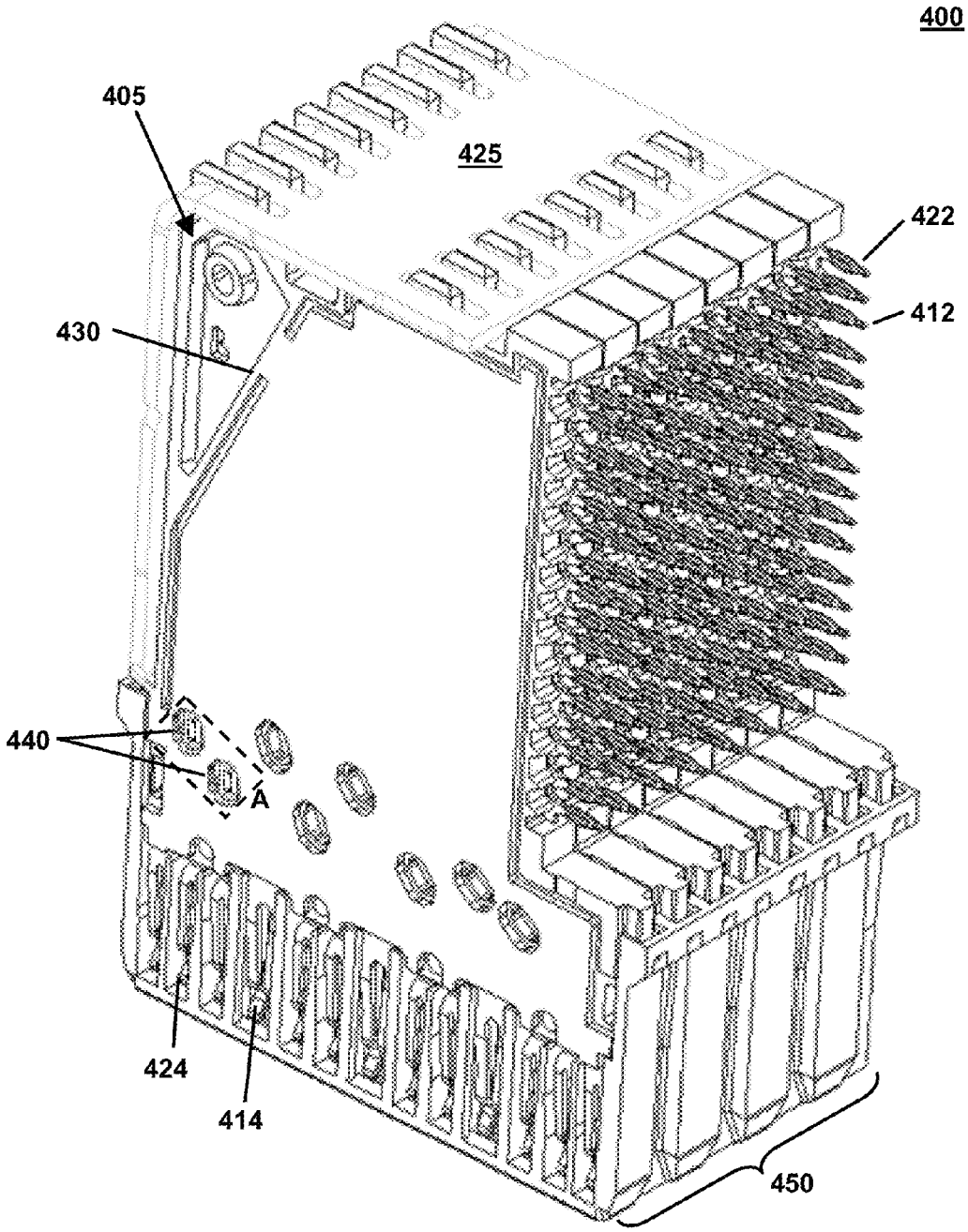
FIG. 4 illustrates a perspective view of an exemplary electrical connector comprising a plurality of wafers, each having one or more electrical conductors onto which passive circuit elements may be mounted, in accordance with an exemplary embodiment of the present invention.
Figure 5A:
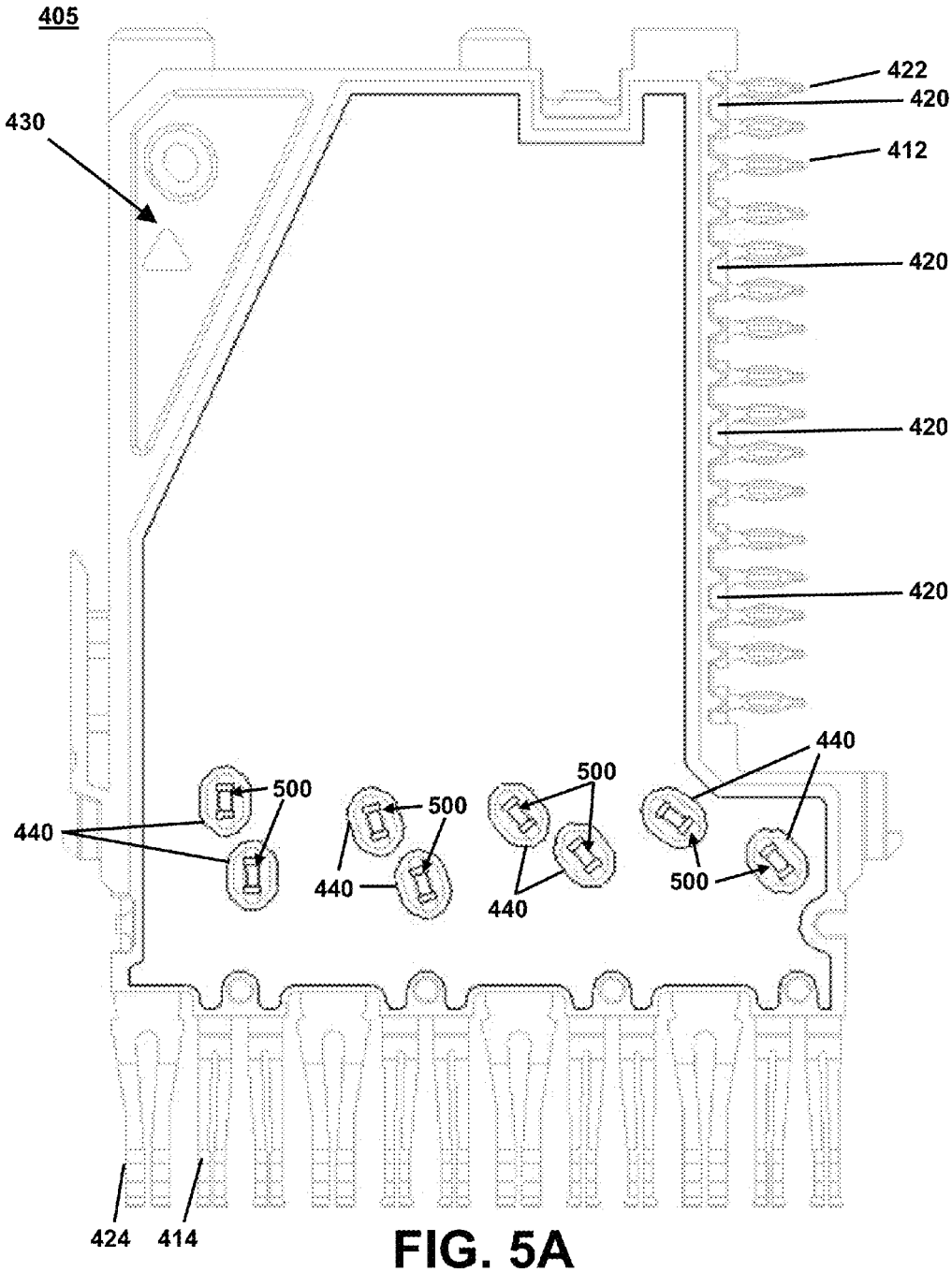
FIG. 5A illustrates a plan view of the top or front of an exemplary wafer of the electrical connector of FIG. 4, the wafer comprising a plurality electrical conductors housed in an insulative housing, each of the electrical conductors having a passive circuit element mounted thereon, in accordance with an exemplary embodiment of the present invention.
Figure 6A:
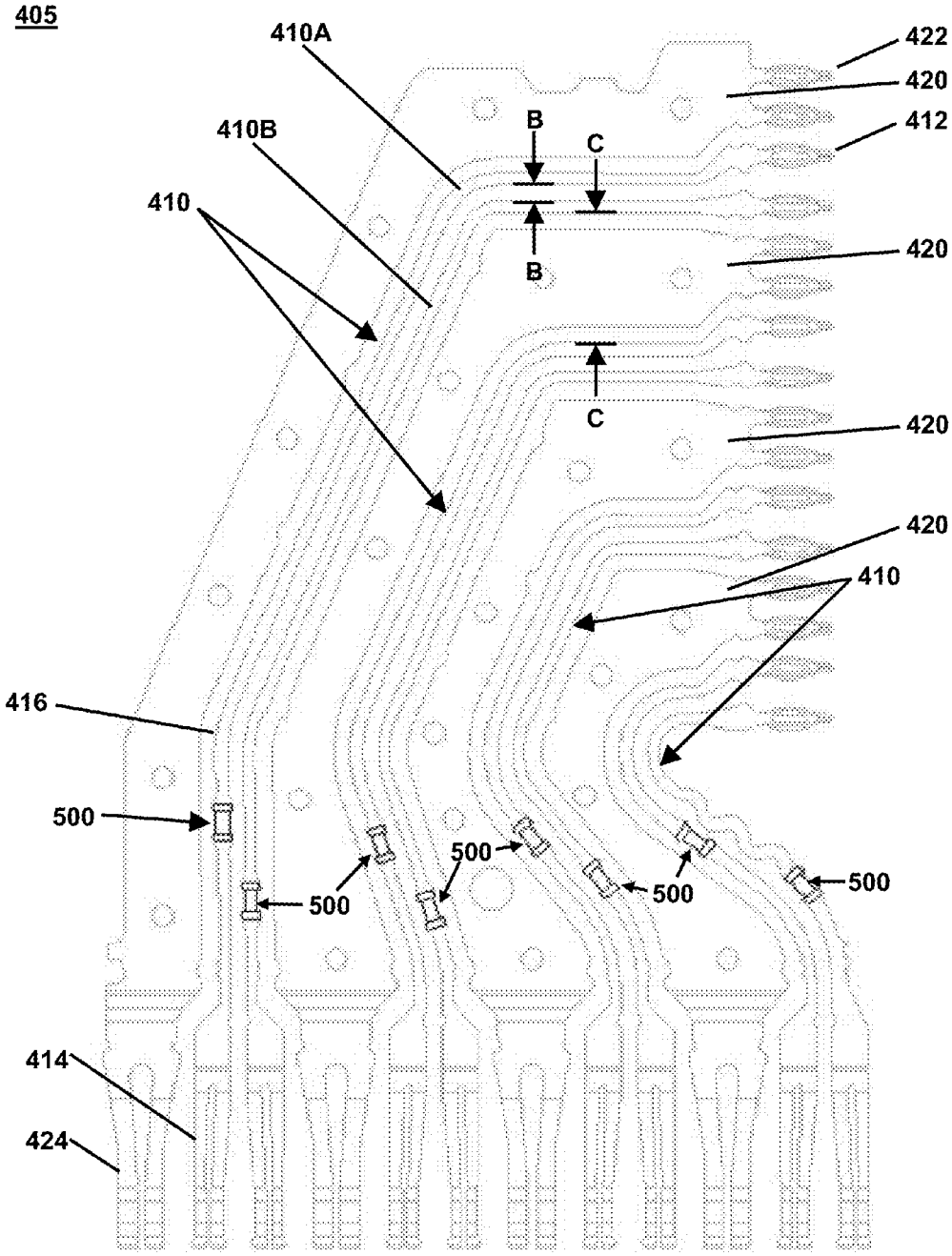
FIG. 6A illustrates a plan view of the wafer of FIG. 5A in which the insulative housing has been removed to expose the plurality of electrical conductors and passive circuit elements, in accordance with an exemplary embodiment of the present invention.

Illustrated in FIG. 4 is a perspective view of an electrical connector 400, in accordance with an exemplary embodiment of the present invention. The electrical connector 400 comprises a wafer 405 coupled to a plurality of like wafers 450 by a stiffener 425. It is to be understood that any of such wafers 450 may be constructed as the wafer 405 is constructed and may be provided with the same or different passive circuit elements described below. Illustrated in FIG. 5A is a plan view of the front or top surface of the wafer 405 illustrated in FIG. 4, in accordance with an exemplary embodiment of the present invention. The wafer 405 comprises a plurality of electrical conductors 410A and 410B (illustrated in FIGS. 6A-6C), onto each of which may be mounted a passive circuit element 500. The wafer 405 further comprises an insulative housing 430. Illustrated in FIG. 6A is a plan view of the wafer 405 with the insulative housing 430 removed to expose the plurality of electrical conductors 410 and passive circuit elements 500, in accordance with an exemplary embodiment of the present invention. FIGS. 4, 5A, and 6A are now described together.

Each pair of the electrical conductors 410A and 410B forms a differential pair 410 of respective signal conductors 410A and 410B. Each differential pair 410 comprises the pair of respective signal conductors 410A and 410B for transmitting signals within frequency ranges of 5-25 or 5-40 GHz. For each differential pair 410, the signal conductors 410A and 410B are spaced at a first distance B-B which is smaller than a second distance C-C between the signal conductors 410A and 410B of adjacent differential pairs 410. In an exemplary embodiment, C-C is at least three times that of B-B. An exemplary value for B-B is 0.45 mm.

Although the pair of signal conductors 410A and 410B are labeled for one differential pair 410 in FIG. 6A (and in FIGS. 6B and 6C), it is to be understood that description herein relating to the conductors 410A and 410B applies to the conductors of all of the plurality of differential pairs 410 labeled in the figures. Further, it is to be understood that although FIG. 6A (and FIGS. 6B and 6C) is illustrated and described as comprising a plurality of differential pairs 410, other embodiments of the wafer 405 comprising one differential pair 410 is contemplated.

Each of the signal conductors 410A and 410B has a first contact end 412, a second contact end 414, and an intermediate portion 416 there between. The intermediate portion 416 of each of the signal conductors 410A and 410B is disposed within the insulative housing 430. Desirably, the wafer 405 also includes a ground conductor member or shield plate 420 adjacent to each differential pair 410. Each ground conductor member 420 comprises a first contact end 422 and a second contact end 424 and may or may not be coplanar with the differential pairs 410. In the embodiment illustrated in FIG. 4, the ground conductor members 420 are separate ground conductor members disposed between the differential pairs 410. It is to be understood that the ground conductor members 420 are not so limited. In a further exemplary embodiment, the ground conductor members 420 are formed as a unitary shield plate disposed in a plane adjacent to the differential pairs 410.

The first contact ends 412 and 422, which are illustrated as press-fit "eye of the needle" contact ends, are connectable to a first printed circuit board (not shown), such as a daughter-card. The second contact ends 414 and 424 are connectable to a second printed circuit board or a mating connector. An example of a mating connector is the backplane connector 50 of FIG. 1. It should be noted that while an exemplary embodiment of the present invention is directed to a two-piece, shielded, differential pair electrical connector assembly (comprising the electrical connector 400 and the backplane connector 50), the concepts described herein are applicable to a one-piece connector, an unshielded connector, a single-ended connector, or any other type of electrical connector.

Figure 5B:
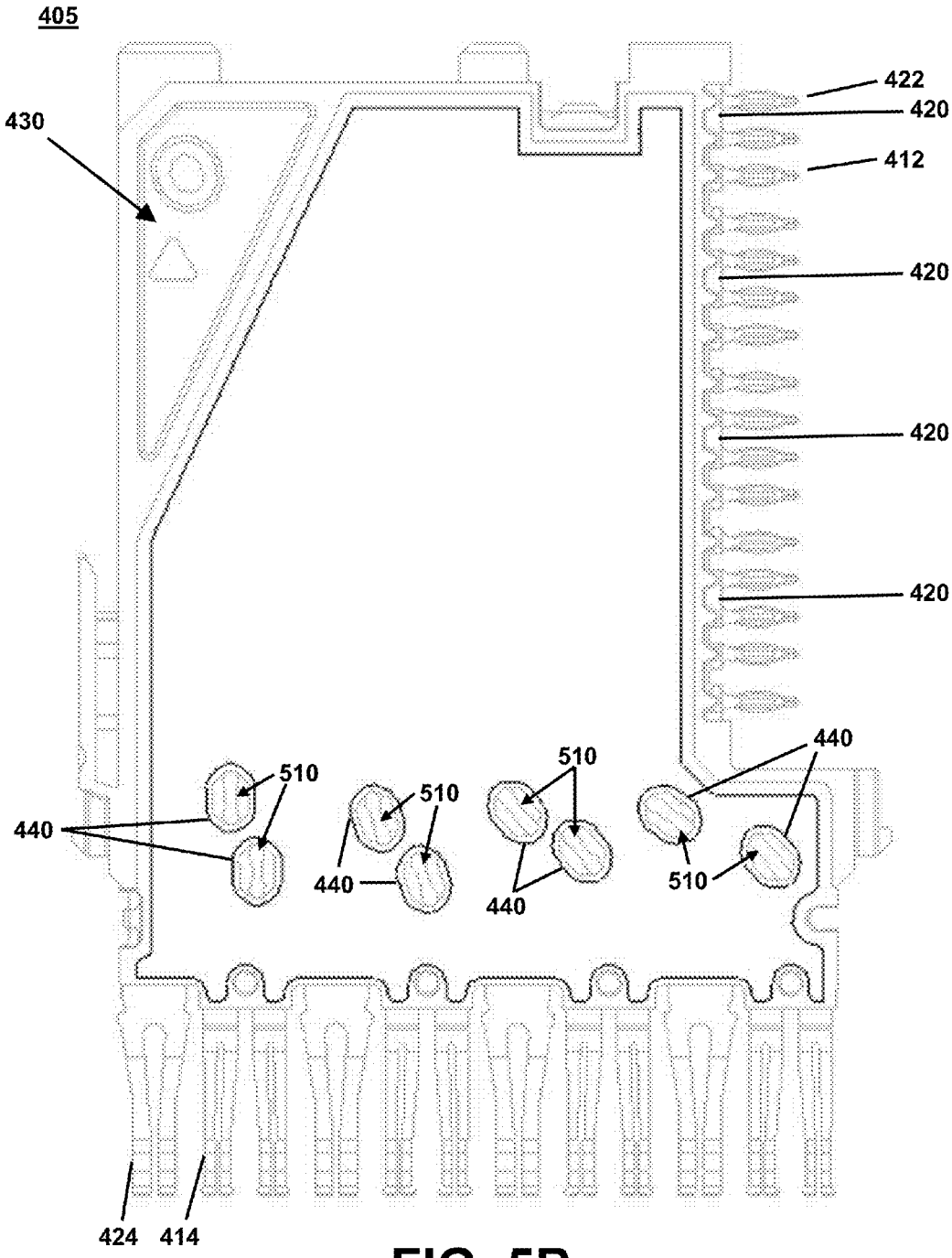
FIG. 5B illustrates a plan view of the wafer of FIG. 5A prior to the passive circuit elements being mounted on the plurality of electrical conductors, in accordance with an exemplary embodiment of the present invention.
Figure 5C:
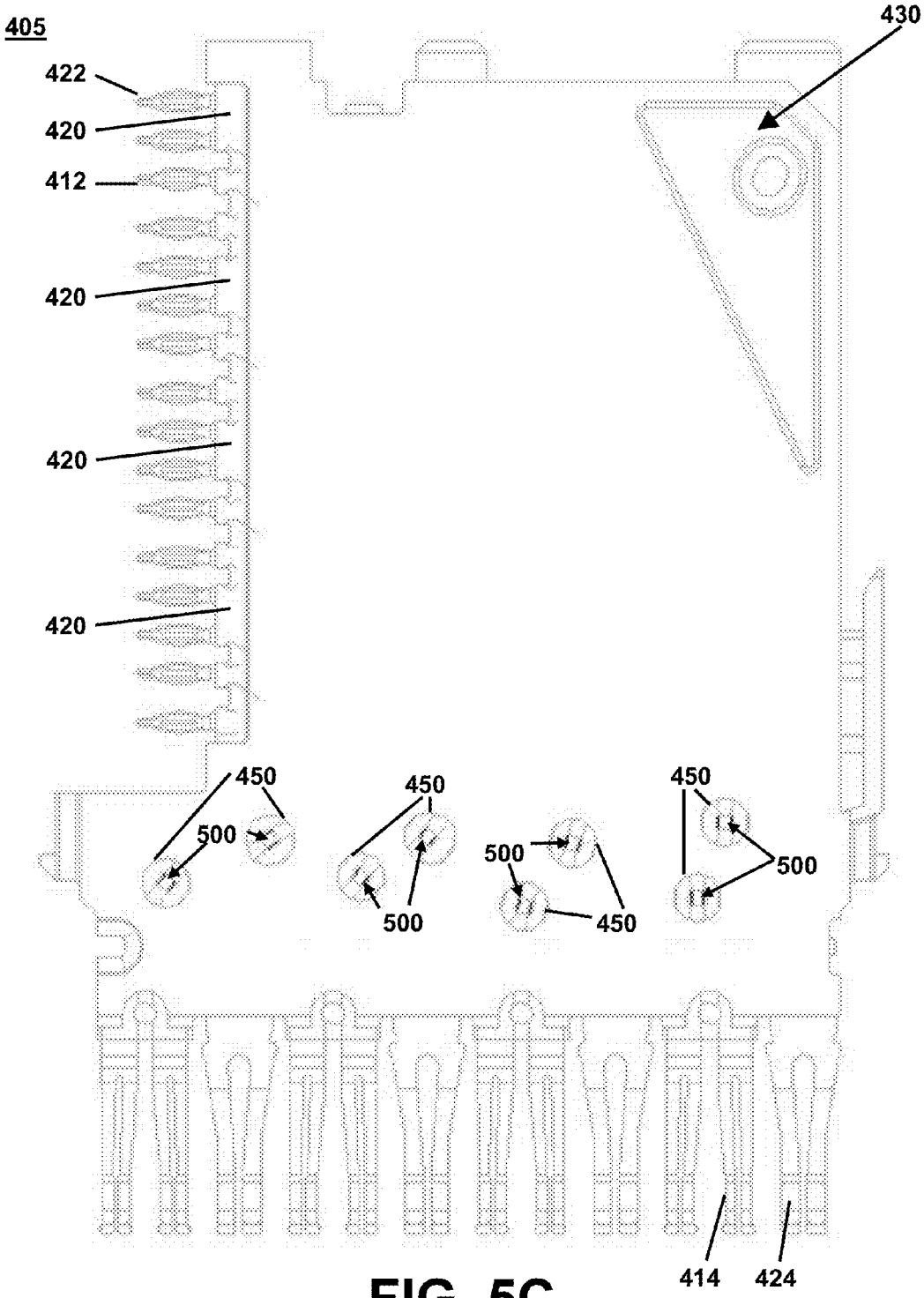
FIG. 5C illustrates a plan view of the bottom or rear of the wafer illustrated in FIG. 5A, in accordance with an exemplary embodiment of the present invention.
Figure 5D:
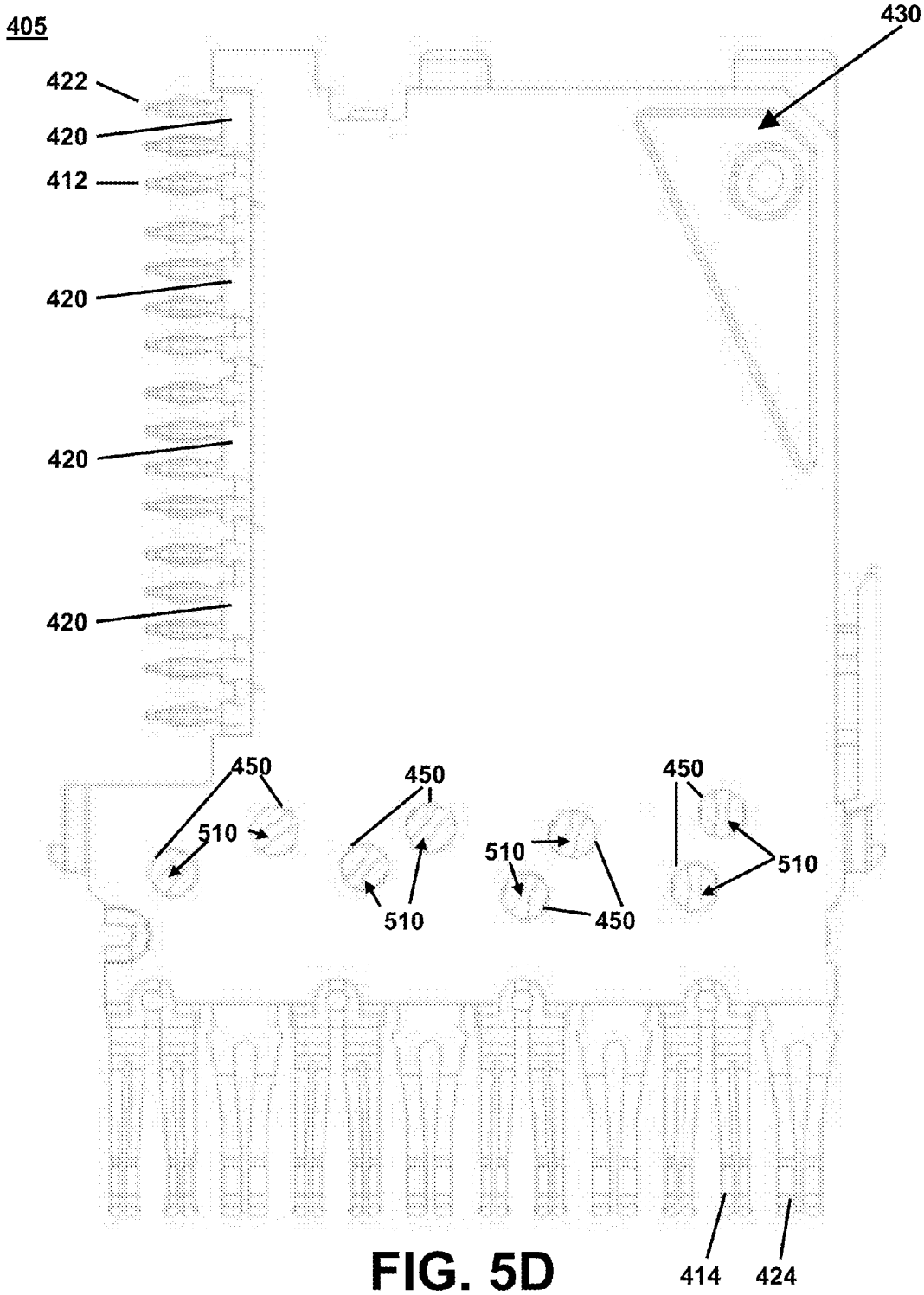
FIG. 5D illustrates a plan view of the bottom or rear of the wafer illustrated in FIG. 5B, in accordance with an exemplary embodiment of the present invention.

Disposed in the insulative housing 430 are a plurality of apertures 440 and 450 (shown in FIGS. 5C and 5D). The apertures 440 provide access to a plurality of electrical connection points 510 (shown in FIGS. 5B and 6B) of the signal conductors 410A and 410B for mounting passive circuit elements 500 thereon. In an exemplary embodiment, the insulative housing 430 is formed from a dielectric (lossy) material, and the apertures 440 are gaps or voids in the dielectric material.

Figure 6B:
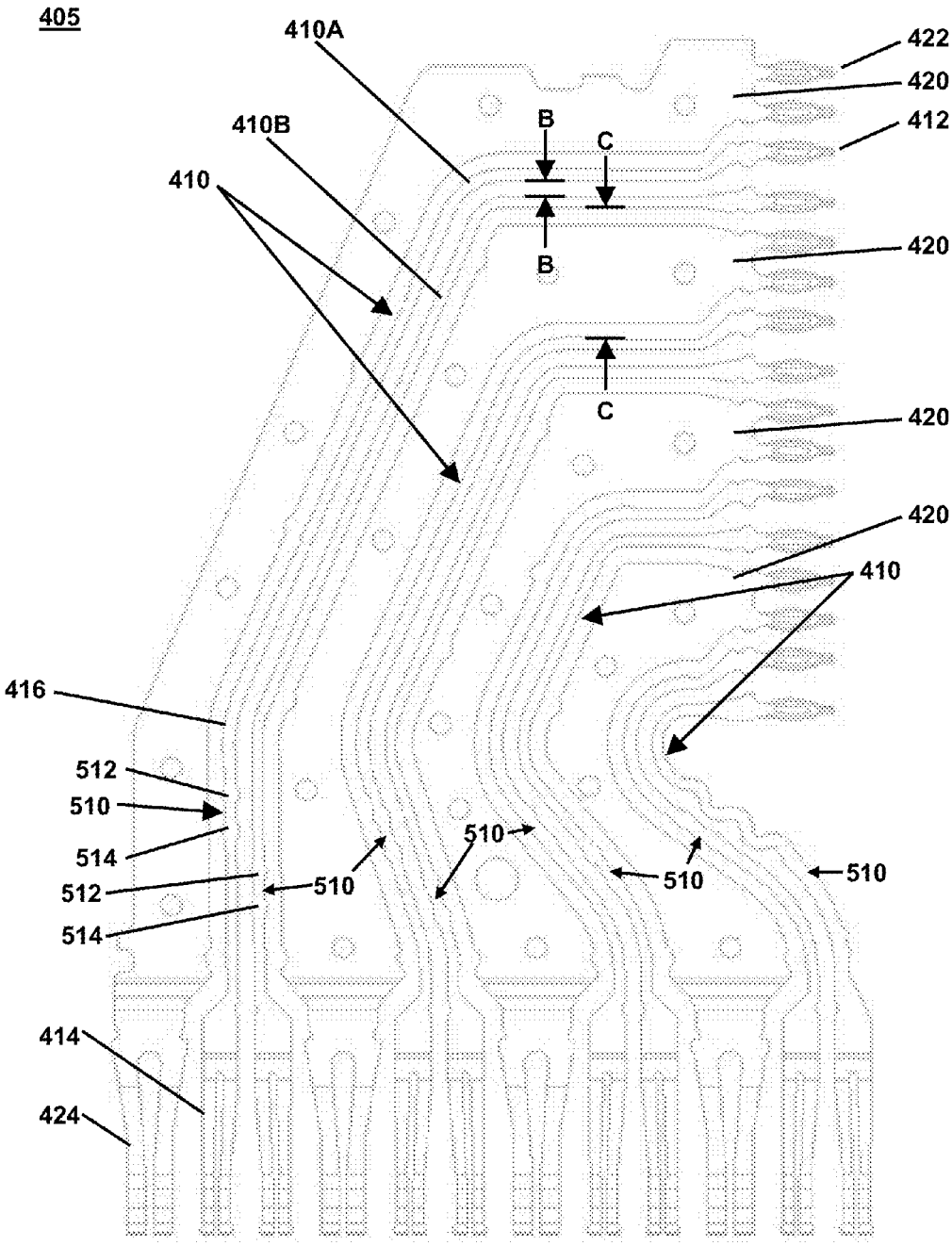
FIG. 6B illustrates a plan view of the wafer of FIG. 5B in which the insulative housing has been removed to expose the plurality of electrical conductors, in accordance with an exemplary embodiment of the present invention.
Figure 6C:
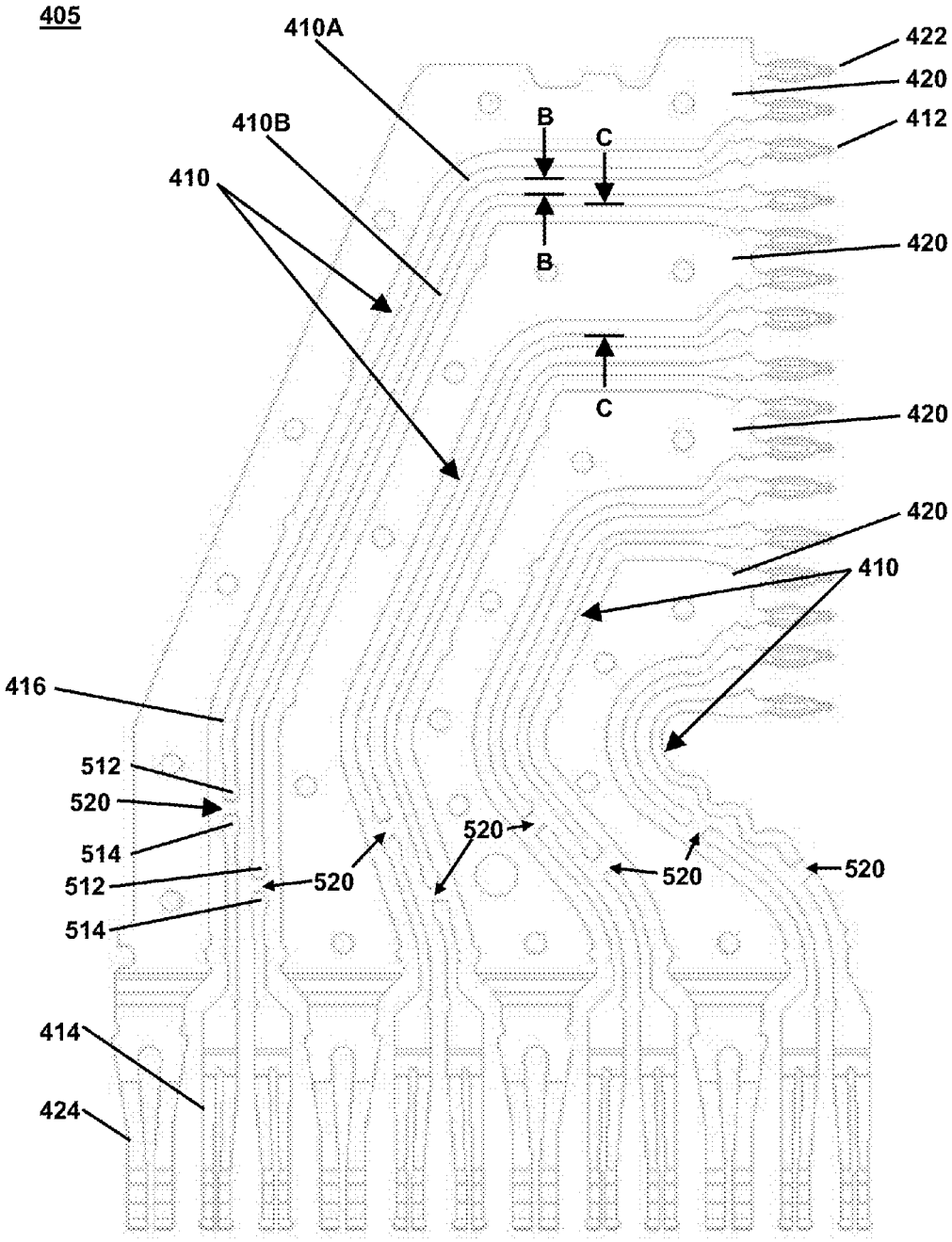
FIG. 6C illustrates a plan view of the plurality of electrical conductors illustrated in FIG. 6B, in which portions of the plurality of electrical conductors have been punched out to accommodate passive circuit elements disposed on respective ones of the plurality of electrical conductors, in accordance with an exemplary embodiment of the present invention.

FIG. 5B illustrates the connection points 510 of the signal conductors 410A and 410B of the differential pairs 410 exposed through the apertures 440 prior to the passive circuit elements 500 being mounted thereon, in accordance with an exemplary embodiment of the present invention. Illustrated in FIG. 6B is a plan view of the wafer 405 of FIG. 5B with the insulative housing 430 removed to expose the connection points 510 of the plurality of differential pairs 410, in accordance with an exemplary embodiment of the present invention. Illustrated in FIG. 6C is a plan view of the wafer 405 of FIG. 6B in which portions of the signal conductors 410A and 410B have been punched out forming gaps 520 to accommodate the mounting of the passive circuit elements 500, in accordance with an exemplary embodiment of the present invention. To summarize, FIGS. 5B and 6B illustrate the configuration of the connection points 510 prior to the voids or gaps 520 being punched in the conductors 410A and 410B for mounting of the passive circuit elements 500 in a manufacturing process. FIG. 6C illustrates the gaps 520 after the portions have been punched out but prior to mounting of the passive circuit elements 500 in a manufacturing process. FIGS. 5A, 5B, and 6A-6C are now described together.

Each signal conductor 410A and 410B for each differential pair 410 comprises at least one connection point 510 located in the intermediate portion 416 of the signal conductor 410A, 410B. The connection point 510 of each signal conductor 410 is provided for mounting the passive circuit element 500. After being punched, as illustrated in FIG. 6C, the intermediate portion 416 of each conductor 410A, 410B of each differential pair 410 includes a gap or break 520 at the connection point 510. For example, the intermediate portion 416 of the conductor 410A includes a gap or break 520 at the connection point 510, as illustrated in FIG. 6C. After being mounted, the passive circuit element 500 straddles the break 520 when installed at the connection point 510. It is to be understood that for any conductor 410A or 410B that is not to include a passive circuit element 500, no punch or break 520 is formed at the connection point 510. Thus, for such conductor 410A or 410B, the connection point 510 would appear as illustrated in FIGS. 5B and 6B.

FIG. 5A illustrates that the passive circuit elements 500 are visible through their respective apertures 440 in the insulative housing 430 after being mounted. FIG. 5B illustrates that the connection points 510 of the differential pairs 410 are visible through their respective apertures prior to the mounting of the passive circuit elements 500. Because the insulative housing 430 is formed from a dielectric, the voids in the insulative housing 430 forming the apertures 440, while desirable for installing the passive circuit elements 500, change the impedance seen by the conductors 410A and 410B of the differential pairs 410. Accordingly, it is desirable to minimize the size of the apertures 440 in the dielectric housing 430 and, generally, to minimize the change in impedance caused by providing access to the conductors 410A and 410B for the option of installing passive circuit elements 500.

Accordingly, in an exemplary embodiment, each aperture 440 has an elongated octagonal shape, as seen in FIGS. 5A and 5B, rather than a square or rectangular shape, to reduce the size of the void forming the aperture 440. The octagonal shape results in less material in the insulative housing 430 being absent compared to a square or rectangular shape. By reducing the size of the void, the elongated octagonal shape reduces the change in impedance seen by the conductors 410A and 410B of the differential pairs 410 compared to the impedance change caused by a square or rectangular shape.

It is to be understood that the apertures 440 are not limited to being elongated octagons having straight edges. Other shapes such as ovals or ellipses are contemplated for reducing the amount of dielectric absent from the insulative housing 430 in the apertures. Illustrated in FIG. 8C is an exemplary alternative embodiment of the aperture 845, generally designated as 845' in FIG. 8C, in accordance with an exemplary embodiment of the present invention. The aperture 845' has a modified octagonal shape comprising substantially straight edges 846 connected by inwardly curved edge corner segments 847. The edges 846 and corner segments 847 are connected by curved ends 848. By including inwardly curved edge corner segments 847 and curved ends 848, the size of the aperture 845' is further reduced over that of the aperture 845, thereby further reducing the effect on impedance in the conductors 410A and 410B. It is to be understood that the substantially straight edges 846 may be curved inwardly in a further exemplary embodiment to adjust the effect on the impedance in the conductors 410A and 410B.

Referring now to FIGS. 5C and 5D, there are illustrated plan views of the rear or bottom of the wafer 405, as respectively illustrated in FIGS. 5A and 5B, in accordance with an embodiment of the present invention. FIG. 5C illustrates the underside of the differential pairs 410 having the passive circuit elements 500 mounted thereon. FIG. 5D illustrates the connection points 510 of the differential pairs 410 prior to the breaks 520 being formed. As can be seen in FIGS. 5C and 5D, the rear or bottom of the wafer 405 comprises a plurality of circular apertures 450 in the insulative housing 430. Although the apertures 450 are illustrated as being circular, it is to be understood that the apertures 450 may have any of the shapes the apertures 440 may have.

The apertures 450 accommodate a punching operation to punch out the breaks 520 in the signal conductors 410A and 410B of the differential pairs 410 so that the passive circuit elements 500 may be mounted across the breaks 520. By including the apertures 450 in the rear of the insulative housing 430, the punched-out portions of the conductors 410A and 410B may fall away from the wafer 405 so that the risk of shorts caused by the punched-out portions is minimized. The apertures 450 are also shaped to minimize their effect on the impedance of the conductors 410A and 410B.

Despite the fact that the apertures 440 and 450 are shaped as elongated octagons, modified elongated octagons, ovals, or ellipses, the apertures 440 and 450 still change the impedances seen by the conductors 410A and 410B of the differential pairs 410. Accordingly, to counteract this change in impedance, the connection points 510 of the conductors 410A and 410B are shaped as barbells, in accordance with an exemplary embodiment of the present invention.

Figure 7A:
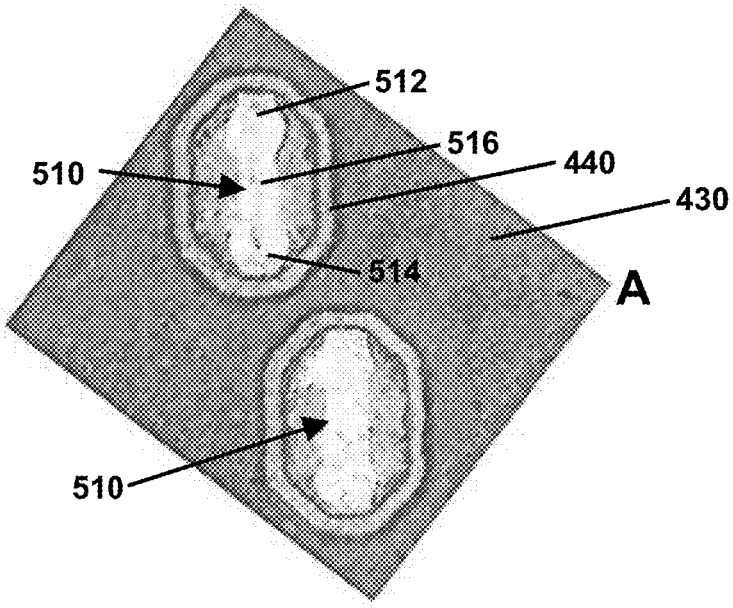
FIGS. 7A-7E illustrate a portion of one of the electrical conductors in various stages of the manufacture of the wafer of FIG. 5A, in accordance with an exemplary embodiment of the present invention.

Illustrated in FIG. 7A is an enlarged view of a portion A of the wafer 405 of FIG. 4, in accordance with an exemplary embodiment of the present invention. As seen in FIG. 7A, the aperture 440 has an elongated octagonal shape and is formed by an octagonal void in the insulative housing 430. Seen through the aperture 440 is the connection point 510 of the conductor 410A within the wafer 405. Discussion of the portion A of the wafer 405 is now made, understanding that the discussion is applicable to all connection points 510 in the wafer 405.

Referring now to FIGS. 6B and 7A together, the barbell shape of the connection point 510 of the conductor 410A, 410B is formed by two circular portions 512 and 514 of the conductor 410A, 410B connected by an intermediate portion 516 of the conductor 410A, 410B (also see FIG. 8C). The circular portions 512 and 514 are wider than the intermediate portion 516, and the intermediate portion 516 is equal in width to the portions of the conductor 410A, 410B outside of the connection point 510. The circular portions 512 and 514 of the conductor 410A, 410B increase the impedance of the conductor 410A, 410B to counteract the change in impedance seen by the differential pair 410 at the apertures 440 and 450 caused by the voids in the dielectric material of the insulative housing 430. Thus, when in its uncut configuration, as shown in FIG. 7, the connection point 510 of the conductor 410A, 410B is impedance matched to the remainder of the conductor 410A, 410B. It is to be understood that the circular portions 512 and 514 are not limited to having circular shapes. Therefore, in an exemplary embodiment, the end portions 512 and 514 may have shapes other than circles, such as squares, hexagons, etc., which shapes are wider than the intermediate portion 516 and provide for impedance matching for the connection point 510.

In addition to being impedance matched to the remainder of the conductor 410A, 410B, the connection point 510 is also designed for mounting a passive circuit element, such as the passive circuit element 500, in series with the conductor 410A, 410B. In an exemplary embodiment of the present invention, the passive circuit element 500 is mounted to the conductor 410A, 410B at the connection point 510, as illustrated in FIG. 7D (described below). The passive circuit element 500 may be selected and mounted depending on the application for the wafer 405.

Figure 9:
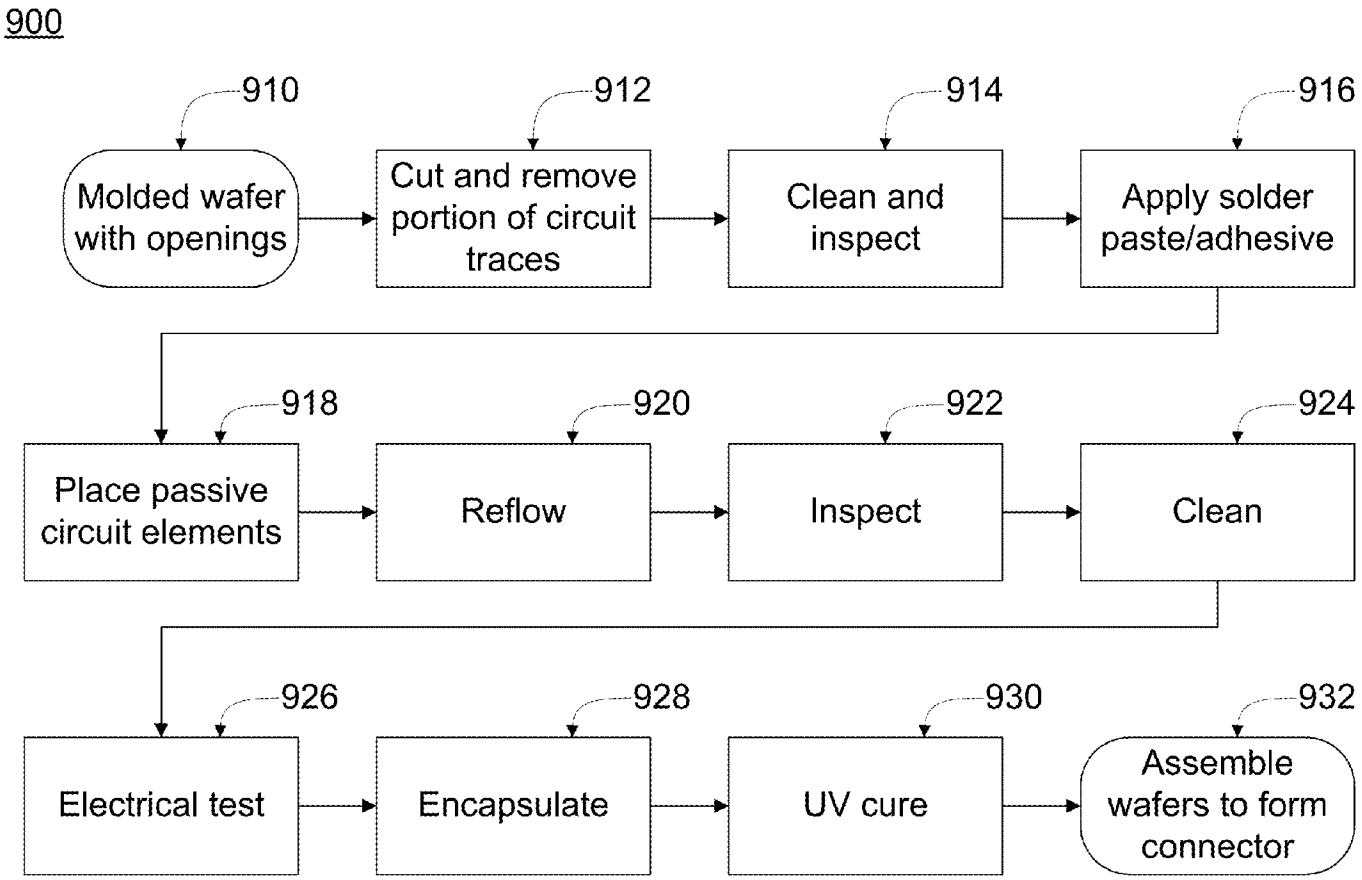
FIG. 9 illustrates a flowchart of an exemplary manufacturing process for the exemplary electrical connector of FIG. 5A, in accordance with an exemplary embodiment of the present invention.

Referring now to FIG. 9, there is illustrated a flowchart 900 of a manufacturing process for mounting a passive circuit element 500 to the connection point 510 of the conductor 410A, in accordance with an exemplary embodiment of the present invention. It is to be understood that as the various process steps of the flowchart 900 are described, some of the steps need not be included in order to manufacture a connector in accordance with the present invention. Furthermore, the sequence of some of the steps may be varied. Description of FIG. 9 is made with reference to FIGS. 7A-E, which illustrate the connection point 510 as it is prepared and mounted with the passive circuit element 500, in accordance with an exemplary embodiment of the present invention. The flowchart 900 illustrates process steps for modifying and adapting a wafer of an existing connector, such as the wafer 405 shown in FIG. 5B, to accept the passive circuit element 500.

The method 900 begins with providing a wafer, such as the wafer 405 of FIG. 4, Step 910. In the Step 910, the wafer 405 is formed by stamping the signal conductors 410A and 410B from a lead frame, as is known in the art. The signal conductors 410A and 410B may be made of a solder wettable material, such as beryllium-copper or the like, and the intermediate portions 416 of the signal conductors 410A and 410B and specifically the connection points 510 may be provided with solder wettable material, such as tin-lead coating, for soldering the passive circuit elements 500 in place. Outside the intermediate portions 416 of the conductors 410A and 410B, the conductors 410A and 410B may be coated with nickel or other non-solder wetting material. FIG. 6B illustrates the plurality of differential pairs 410 (comprising the conductors 410A and 410B) and the plurality of ground conducting members 420 after being punched from the lead frame. It is to be understood that the signal conductors 410A and 410B are formed in the lead frame to include the connections points 510 having the barbell shapes and the circular portions 512 and 514 illustrated in FIG. 6B.

While holding the signal conductors 410A and 410B of the plurality of differential pairs 410 in place by clamps or fingers, the insulative housing 430 of the wafer 405 is injection molded around the plurality of differential pairs 410. The housing 430 is molded to form the apertures 440 and 450 through which at least a portion of the connection points 510 are exposed. The wafer 405 is thereby provided in the Step 910. An exemplary view of the connection points 510 is shown in FIG. 7A.

Figure 7B:
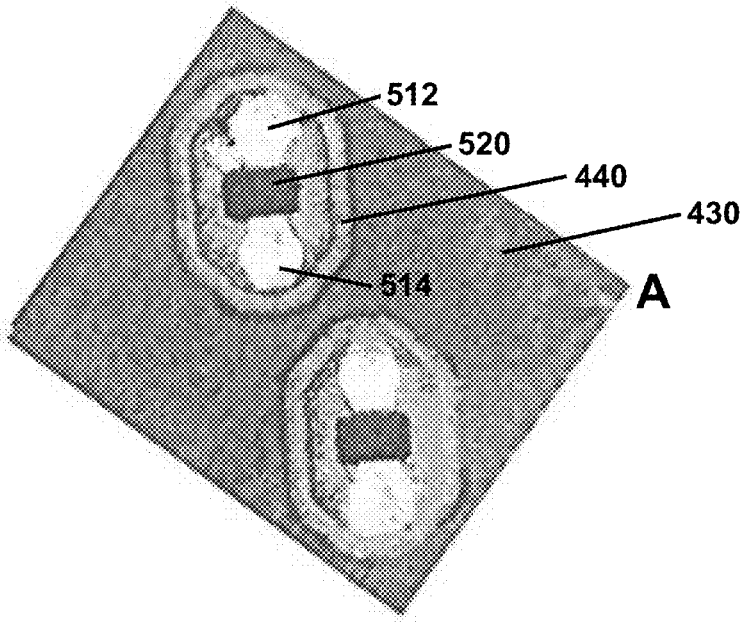

The method 900 continues to a Step 912 in which the intermediate portions 516 of the connection points 510 of selected conductors 410A, 410B of selected differential pairs 410 are punched and removed to form selected punch holes or breaks 520 to sever the electrical connection between the circular portions 512 and 514 of the selected connection points 510, as illustrated in FIG. 7B. It is desirable that the punch holes or breaks 520 pass entirely through the intermediate portion 516 to ensure electrical separation of the circular portions 512 and 514. In an exemplary embodiment, the punch holes 520 are rectangular, as illustrated in FIG. 7B.

Figure 7C:
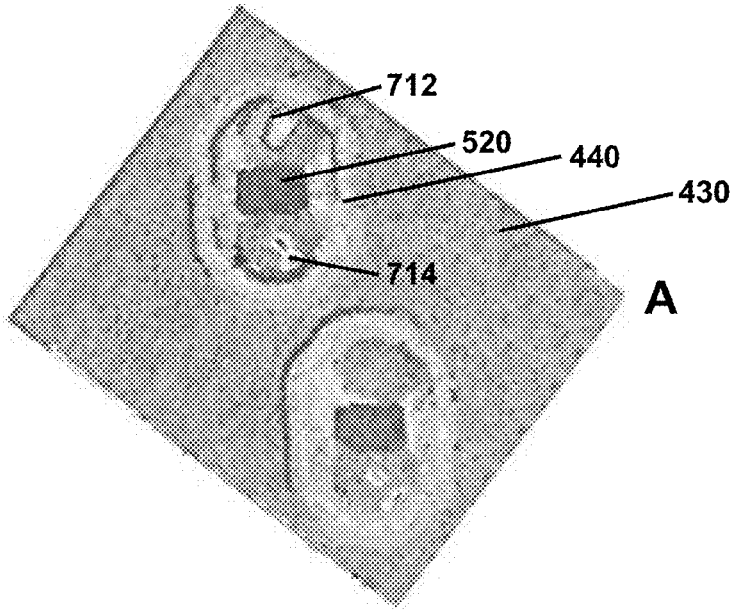
Figure 7D:
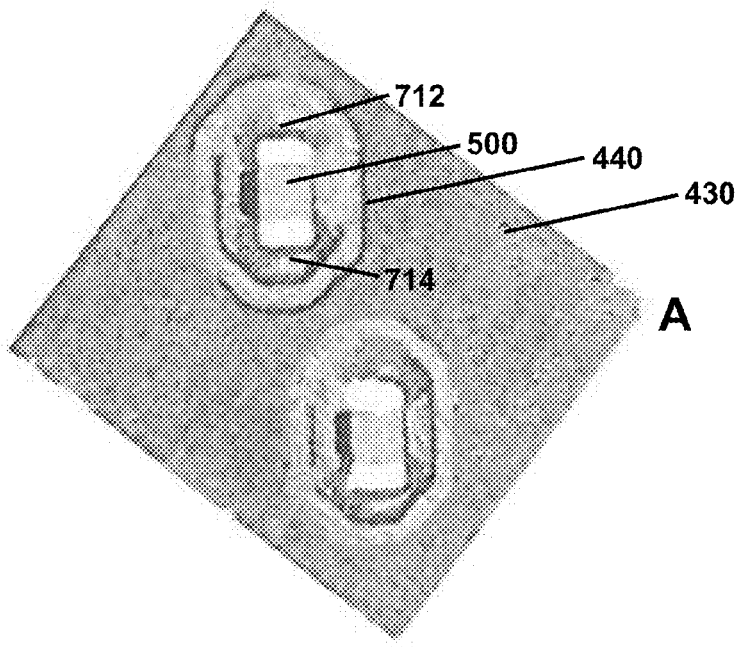

In a Step 914, the water 405 is cleaned and inspected. This step can be performed manually or automatically, and can be bypassed if desired. In a Step 916, solder paste or conductive adhesive 712 and 714 is applied, respectively, to the circular portions 512 and 514 of the selected connection points 510, as illustrated in FIG. 7C. The solder paste or conductive adhesive does not flow into the punch holes 520 because of the surface tension and viscosity of the solder paste or conductive adhesive and because of the size of the punch holes 520.

A passive circuit element 500 is then placed onto each selected connection points 510 to bridge the punch hole 520, Step 918. In an exemplary embodiment, the passive circuit element 500 may be any surface mounted passive device, such as surface-mounted resistors, capacitors, or inductors, capable of being disposed in the apertures 440, as illustrated in FIG. 7D. The surface mounted passive device may be encapsulated in an insulative package and may be a resistor, capacitor, or inductor, commercially available off the shelf. For example, if the passive circuit element 500 is desired to function as a direct current blocking circuit, then one of the ceramic or tantalum chip capacitors that are sold by KEMET Electronics Corporation of Greenville, S.C. can be utilized. The technical information for these ceramic or tantalum chip capacitors is available from KEMET (www.kemet.com) and is incorporated by reference herein. If the passive circuit element 500 is desired to function as a high frequency passive equalization circuit, then one of the resistor/inductor/capacitor packages that are sold by Maxim Integrated Products, Inc. of Sunnyvale, Calif. can be utilized. The technical information for these packages is available from Maxim (www.maxim-ic.com) and is incorporated by reference herein.

If solder is used, in a Step 920, the passive circuit element 500 is soldered to the circular portions 512 and 514 of the selected connection point 510 by heating the solder paste 712 and 714. When heated, flux contained in solder paste 712 and 714 evaporates, thereby preparing the circular portions 512 and 514. The solder 712 and 714 then melts to bind the passive circuit element 500 to the circular portions 512 and 514. The passive circuit element 500 is thereby mounted to the connection point 510. If conductive paste is used, the passive circuit element 500 is bound to the circular portions 512 and 514 in the Step 918, and the Step 920 is bypassed.

While it is desirable in the Step 916 to apply the solder paste or conductive adhesive to the circular portions 512 and 514 of the connection point 510, it is to be understood that the solder paste/conductive adhesive may instead be applied to the ends of the passive circuit element 500 before or after the Step 918 or to both the remaining circular portions 512 and 514 of the selected connection point 510 and the ends of the passive circuit elements 500.

Figure 7E:
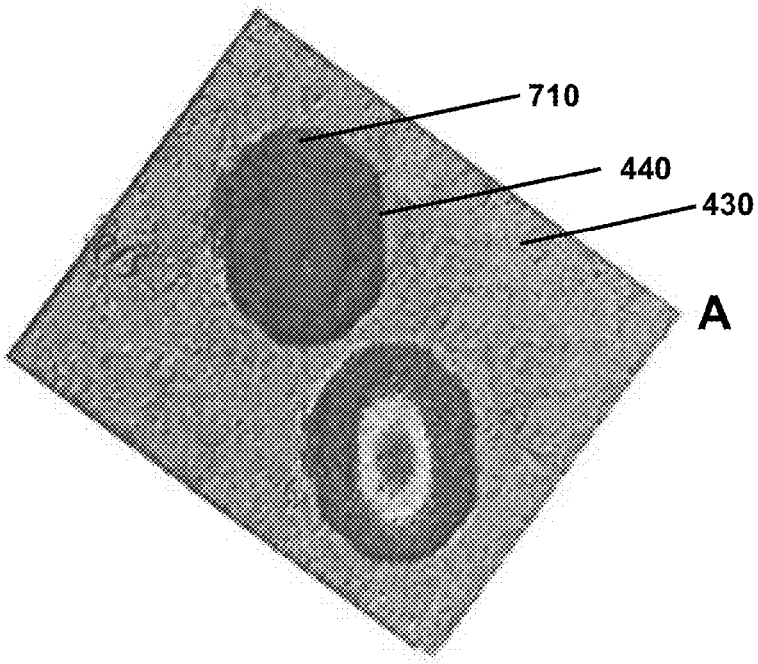

In a Step 922, the attachment of the mounted passive circuit element 500 is inspected, and in a Step 924, the attachment area around the passive circuit element 500 and the portions of the circular portions 512 and 514 remaining exposed are cleaned. The attachment of the passive circuit element 500 is then tested for electrical continuity across the connection point 510, Step 926. If the attachment test is successful, insulating material 710 is deposited into the aperture 440, Step 928, as illustrated in FIG. 7E. The insulating material 710 is then cured by ultraviolet light, Step 930, and the wafer 405 is assembled to the plurality of wafers 450 to form the connector 400, Step 932, in accordance with an exemplary embodiment of the present invention. In an exemplary embodiment, the insulating material 710 is also deposited into the aperture 450 in the Step 928 and is cured in the Step 930. Encapsulation is advantageous to keep moisture out, absorb shocks and vibration, and prevent conductive whiskers from forming at the connection point 510.

It is to be understood that the Steps 912 through 930 are performed for all connection points 510 selected to receive a passive circuit element 500 prior to the Step 932 being performed. Further, the connection points 510 of the conductors 410A and 410B not selected to receive passive circuit elements 500 need not have Steps 912-930 performed thereon and, therefore, need not have their respective apertures 440 encapsulated.

While the flowchart 900 concerns cutting and removing a portion 516 of each selected connection point 510 after the insulative housing 430 has been molded around the plurality of differential pairs 410, it is certainly possible, and in some cases even preferable, to cut and remove the portion 516 of each selected connection point 510 before the insulative housing 430 has been molded around the plurality of differential pairs 410.

Figure 8A:
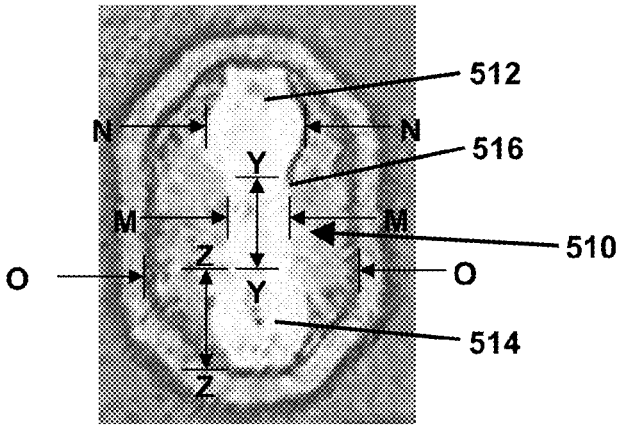
FIG. 8A illustrates various dimensions of the portion of the electrical conductor of FIGS. 7A-7E, in accordance with an exemplary embodiment of the present invention.
Figure 8B:
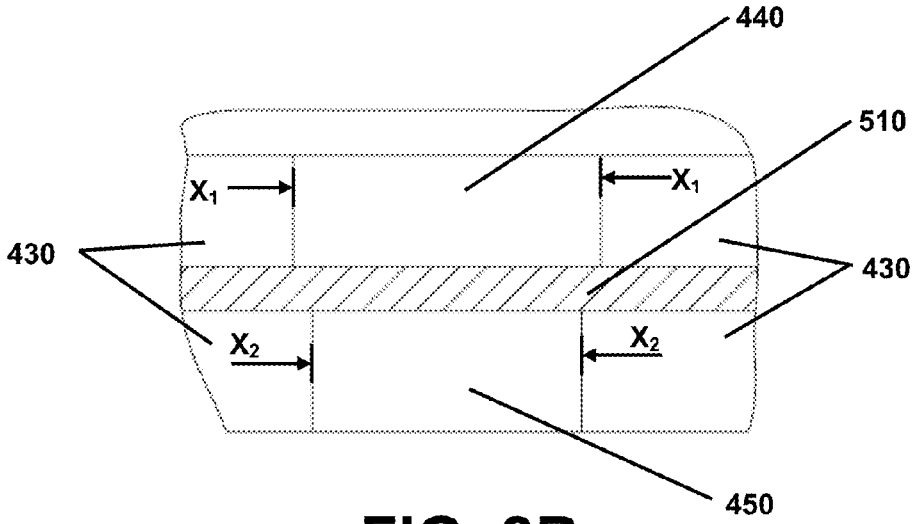
FIG. 8B illustrates various dimensions of apertures in the insulative housing of the wafer of FIG. 5A, in accordance with an exemplary embodiment of the present invention.
Figure 8C:
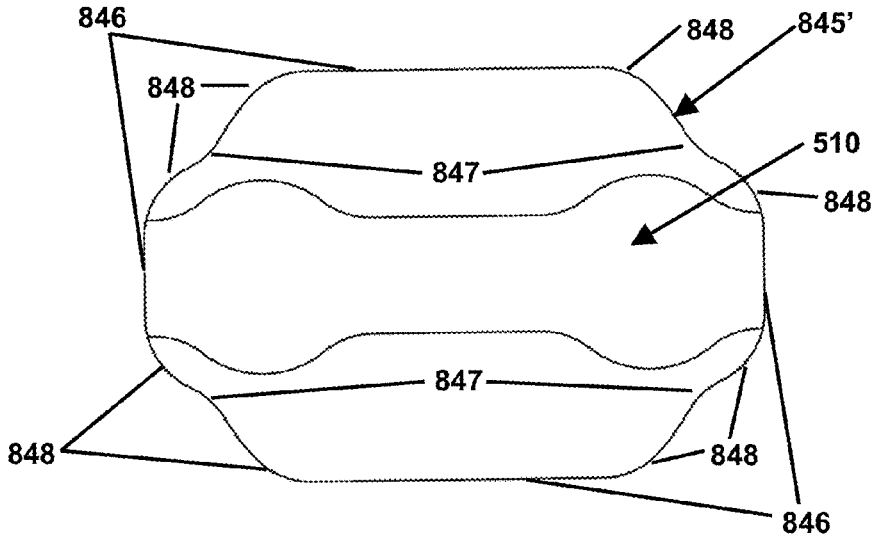
FIG. 8C illustrates an exemplary alternative embodiment of the apertures in the insulative housing of the wafer of FIG. 5A, in accordance with an exemplary embodiment of the present invention.

Referring now to FIGS. 8A and 8B, there are illustrated exemplary dimensions of an exemplary connection point 510 and exemplary apertures 440 and 450 prior to a passive circuit element 500 being mounted. Dimension $X_1$ in the figures is the length of the aperture 440. Dimension O is the width of the aperture 440. Dimension $X_2$ is the diameter of the aperture 450. The intermediate portion 516 of the connection point 510 has a length Y and a width M. The circular portions 512 and 514 of the connection point 510 have a length Z and a width N.

In an exemplary embodiment of the present invention, the passive circuit elements 500 may be packaged in a 0402 package known in the art. The dimensions for such package are as follows: 1.00 mm length; 0.50 mm height; and 0.50 mm width. If such package is used, the exemplary values for the dimensions illustrated in FIGS. 8A and 8B are as follows: $X_1$=1.60 mm; $X_2$=1.40 mm; Y=0.46 mm; Z=0.8 mm; M=0.3 mm; N=0.5 mm; and O=1.06 mm. It is to be understood that the dimensions for each exemplary connection point 510 and apertures 440 and 450 having a passive circuit element 500 in a 0402 package may equal to the foregoing.

Other package sizes for the passive circuit elements 500 are contemplated. For example, the passive circuit elements 500 may be packaged in a 0201 package known in the art. The dimensions for such package are as follows: 0.50 mm length; 0.25 mm height; and 0.25 mm width. It is to be understood that for passive circuit elements 500 packaged in 0201 packages, the exemplary values for the dimensions illustrated in FIGS. 8A and 8B are half the exemplary values for such dimensions when a 0402 package is used.

It is to be understood that the foregoing exemplary dimensions are not to be construed as limitations on the sizes of the exemplary connection point 510 and apertures 440 and 450. Rather, it is to be understood that as the sizes of the passive circuit elements 500 are changed, the dimensions of the exemplary connection point 510 and apertures 440 and 450 may change accordingly. For example, if the passive circuit elements 500 are shrunk by a factor of ½, ¼, etc. over the foregoing exemplary sizes, the dimensions of the exemplary connection point 510 and apertures 440 and 450 may also be shrunk by a factor of ½, ¼, etc. over the exemplary foregoing dimensions.

Having described the preferred embodiment of the invention, it will now become apparent to one of ordinary skill in the art that other embodiments incorporating their concepts may be used. Accordingly, these embodiments should not be limited to disclosed embodiments but rather should be limited only by the spirit and scope of the appended claims. All publications and references cited herein are expressly incorporated herein by reference in their entirety.

These and other advantages of the present invention will be apparent to those skilled in the art from the foregoing specification. Accordingly, it is to be recognized by those skilled in the art that changes or modifications may be made to the above-described embodiments without departing from the broad inventive concepts of the invention. It is to be understood that this invention is not limited to the particular embodiments described herein, but is intended to include all changes and modifications that are within the scope and spirit of the invention.

What is claimed is:

1. An electrical wafer for connecting to a printed circuit board, the electrical wafer comprising:

an insulative housing; and at least one signal conductor comprising an intermediate portion comprising a connection point, the connection point comprising first and second ends having a width greater than a portion of the at least one signal conductor outside the connection point, wherein the insulative housing comprises at least one aperture exposing at least a portion of the connection point.

2. The electrical wafer of claim 1, wherein the connection point further comprises an intermediate portion electrically connecting the first and second ends of the connection point.

3. The electrical wafer of claim 2, wherein the intermediate portion has a width equal to the portion of the at least one signal conductor outside the connection point.

4. The electrical wafer of claim 1, wherein the connection point is impedance matched to the portion of the at least one signal conductor outside the connection point.

5. The electrical wafer of claim 1, wherein the connection point further comprises a break between the first and second ends of the connection point, the electrical wafer further comprising at least one circuit element mounted to the connection point over the break, the at least one circuit element comprising a first end secured and electrically coupled to the first end of the connection point and a second end secured and electrically coupled to the second end of the connection point.

6. The electrical wafer of claim 5, wherein the at least one circuit element comprises at least one passive circuit element housed in an insulative package.

7. The electrical wafer of claim 1, wherein the at least one aperture has an elongated octagonal shape.

8. The electrical wafer of claim 1, wherein the at least one aperture has an oval or elliptical shape.

9. The electrical wafer of claim 1, wherein the at least one signal conductor is a first signal conductor and the connection point is a first connection point, the electrical connector further comprising at least one differential pair of signal conductors comprising the first signal conductor and a second signal conductor comprising a second intermediate portion comprising a second connection point.

10. An electrical connector comprising: a plurality of wafers, each wafer comprising:

an insulative housing; and at least one signal conductor comprising an intermediate portion comprising a connection point, the connection point comprising first and second ends having a width greater than a portion of the at least one signal conductor outside the connection point; and a stiffener configured to hold the plurality of wafers in parallel to one another, wherein the insulative housing of each wafer comprises at least one aperture exposing at least a portion of the connection point of the at least one signal conductor of each wafer.

11. The electrical connector of claim 10, wherein, for each wafer, the connection point of the at least one signal conductor further comprises an intermediate portion electrically connecting the first and second ends of the connection point.

12. The electrical connector of claim 11, wherein, for each wafer, the intermediate portion of the connection point of the at least one signal conductor has a width equal to the portion of the at least one signal conductor outside the connection point.

13. The electrical connector of claim 10, wherein, for each wafer, the connection point of the at least one signal conductor is impedance matched to the portion of the at least one signal conductor outside the connection point.

14. The electrical connector of claim 10, wherein, for each wafer, the connection point further comprises a break between the first and second ends of the connection point, the each wafer further comprising at least one circuit element mounted to the connection point over the break, the at least one circuit element comprising a first end secured and electrically coupled to the first end of the connection point and a second end secured and electrically coupled to the second end of the connection point.

15. The electrical connector of claim 14, wherein, for each wafer, the at least one circuit element comprises at least one passive circuit element housed in an insulative package.

16. The electrical connector of claim 10, wherein, for each wafer, the at least one aperture has an elongated octagonal shape.

17. The electrical connector of claim 10, wherein, for each wafer, the at least one aperture has an oval or elliptical shape.

18. The electrical connector of claim 10, wherein, for each wafer, the at least one signal conductor is a first signal conductor and the connection point is a first connection point, the electrical connector further comprising at least one differential pair of signal conductors comprising the first signal conductor and a second signal conductor comprising a second intermediate portion comprising a second connection point.

19. An electrical connector assembly comprising:

a plurality of wafers, each wafer comprising:

an insulative housing; and at least one signal conductor comprising an intermediate portion comprising a connection point, the connection point comprising first and second ends having a width greater than a portion of the at least one signal conductor outside the connection point; and a stiffener configured to hold the plurality of wafers in parallel to one another; and a back plane connector configured to connect to a first end of each wafer, wherein the insulative housing of the each wafer comprises at least one aperture exposing at least a portion of the connection point of the at least one signal conductor of each wafer.

20. The electrical connector assembly of claim 19, wherein, for each wafer, the connection point further comprises a break between the first and second ends of the connection point, the each wafer further comprising at least one circuit element mounted to the connection point over the break, the at least one circuit element comprising a first end secured and electrically coupled to the first end of the connection point and a second end secured and electrically coupled to the second end of the connection point.

* * * * *